US006422146B1

(12) United States Patent
Vetter

(10) Patent No.: US 6,422,146 B1
(45) Date of Patent: Jul. 23, 2002

(54) IGNITER UNIT FOR AN INFLATOR

(75) Inventor: Johann Vetter, Wasserburg (DE)

(73) Assignee: TRW Airbag Systems GmbH & Co. KG, Aschau/Inn (DE)

( * ) Notice: Subject to any disclaimer, the term of this patent is extended or adjusted under 35 U.S.C. 154(b) by 0 days.

(21) Appl. No.: 09/649,704

(22) Filed: Aug. 25, 2000

(30) Foreign Application Priority Data

Aug. 27, 1999 (DE) ..... 299 15 056 U

(51) Int. Cl.[7] ..... F42C 19/08

(52) U.S. Cl. ..... 102/202.9; 102/202.11; 102/202.14

(58) Field of Search ..... 102/202.9, 202.11, 102/202.12, 202.14

(56) References Cited

U.S. PATENT DOCUMENTS

| | | | | | |
|---|---|---|---|---|---|
| 2,386,211 | A | * | 10/1945 | Grant, Jr. | 102/202.9 |
| 3,040,284 | A | * | 6/1962 | Connell | 102/202.9 |
| 3,101,669 | A | * | 8/1963 | Gatley et al. | 102/202.9 |
| 3,180,263 | A | * | 4/1965 | Williams, Jr. | 102/202.9 |
| 3,585,933 | A | * | 6/1971 | Kos | 102/202.9 |
| 3,682,096 | A | * | 8/1972 | Ludke et al. | 102/202.11 |
| 4,369,707 | A | * | 1/1983 | Budde | 102/202.9 |
| 4,745,858 | A | * | 5/1988 | Harder | 102/202.9 |
| 4,938,137 | A | * | 7/1990 | Guay | 102/202.9 |
| 4,959,011 | A | * | 9/1990 | Nilsson | 102/202.9 |
| 5,200,574 | A | * | 4/1993 | Cunningham et al. | 102/202.9 |
| 5,241,910 | A | * | 9/1993 | Cunningham et al. | 102/202.9 |
| 5,648,634 | A | * | 7/1997 | Avory et al. | 102/202.14 |
| 6,070,531 | A | * | 6/2000 | Hansen et al. | 102/202.9 |
| 6,155,171 | A | * | 12/2000 | Haegeman et al. | 102/202.9 |
| 6,164,208 | A | * | 12/2000 | Hsu et al. | 102/202.9 |

FOREIGN PATENT DOCUMENTS

| | | |
|---|---|---|
| DE | 2926375 | 1/1980 |
| DE | 4429175 | 3/1995 |
| DE | 4444591 | 6/1995 |
| DE | 19650761 | 6/1997 |
| DE | 29813163 | 2/1999 |

* cited by examiner

*Primary Examiner*—Peter M. Poon
*Assistant Examiner*—Lulit Semunegus
(74) *Attorney, Agent, or Firm*—Tarolli, Sundheim, Covell, Tummino & Szabo L.L.P.

(57) ABSTRACT

An igniter unit for an inflator unit comprises a base in which electric contact pins are arranged and a plug for plugging into the base to contact the contact pins. The plug is provided with at least one key and the base is provided with at least one guide groove for the key.

4 Claims, 1 Drawing Sheet

IGNITER UNIT FOR AN INFLATOR

TECHNICAL FIELD

The invention relates to an igniter unit for an inflator.

BACKGROUND OF THE INVENTION

A typical igniter unit comprises a base in which electric contact pins are arranged, and a plug for plugging into the base to contact the contact pins, and serves to convert an electric pulse furnished via the contact pins in such a manner that a gas generant of the inflator is reliably ignited. The quantity of compressed gas then made available by the gas generant may be used, for example, to actuate a piston of a linear drive as employed, for example, for a belt tensioner or for deploying a gas bag of a gas bag restraint system.

One salient requirement on such an igniter unit is that reliable contacting of the contact pins must be assured. This requires, in particular, that the contact pins must not be damaged neither when plugging the plug into the base nor when the plug is plugged in the base.

BRIEF SUMMARY OF THE INVENTION

This is achieved in an igniter unit which comprises a base in which electric contact pins are arranged and a plug for plugging into the base to contact the contact pins. The plug is provided with at least one key and the base is provided with at least one guide groove for the key. In this arrangement, the plug is prevented from twisting relative to the base and thus relative to the contact pins. Any torque acting between the plug and the base is directed by means of the guide groove and the key directly into the base so that there is no load on the contact pins. This assures that the contact pins cannot be sheared off, neither when plugging the plug into the base nor later when the plug is plugged in.

Preferably two keys and two guide grooves are provided arranged angularly spaced away from each other by an angle other than 180° to thus achieve keying, i.e. ensuring that the plug can only be plugged into the base in its one and only correct orientation.

Preferably the base is provided with a collar adapted for engaging a boss on the plug. This collar may be flanged or crimped so that the plug, when plugged into the base, is non-releasably connected thereto.

According to a preferred embodiment of the invention it is provided for that a sealing ring is disposed between the base and the plug. This prevents the ingress of moisture and dirt into the interior of the igniter unit to thus ensure reliably contacting of the contact pins even over a long operating period.

Preferably arranged in the base is an igniter from which the electric contact pins protrude. The contact pins are thus designed as an integral component of the igniter, making simple assembly of the igniter unit possible. The base then merely serves as a link between the igniter provided with the contact pins and the plug plugged onto the contact pins.

Advantageous embodiments of the invention read from the sub-claims.

DETAILED DESCRIPTION OF THE PREFERRED EMBODIMENT

Figure 1:
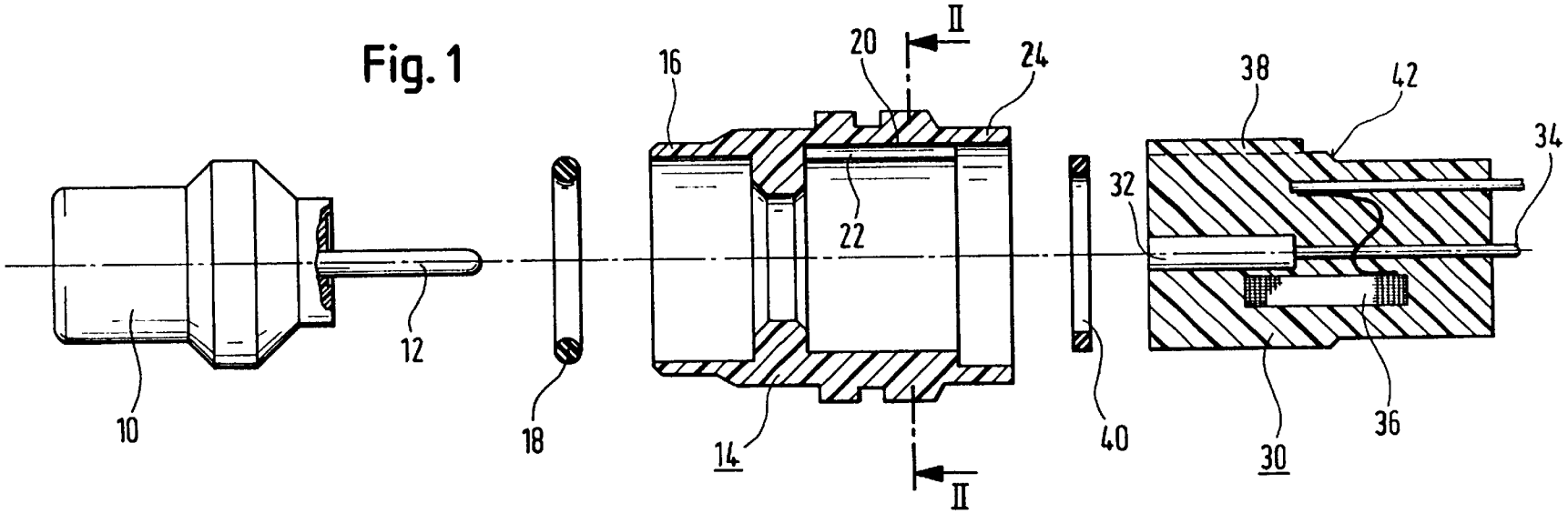
FIG. 1 is a sectional exploded view of an igniter unit according to the invention and FIG. 2 is a section taken along the line II—II through the base part as shown in FIG. 1 with the igniter inserted.

Referring now to FIG. 1 there is illustrated the igniter system comprising an igniter 10 provided with two electric contact pins 12.

The igniter 10 is held by the base 14 provided with an apron 16. For assembly the igniter 10 is inserted together with the sealing ring 18 into the base so that the free edge of the apron 16 can be flanged, the igniter 10 then being firmly connected to the base 14.

Figure 2:
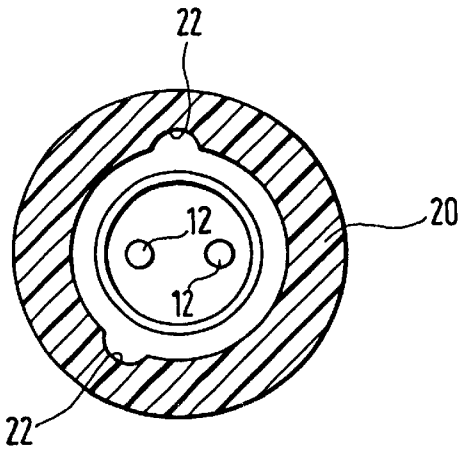

The base comprises in addition a receptacle section 20 into which a plug 30 can be plugged in. Referring now to FIG. 2 it is evident that the receptacle section 20 is provided with two guide grooves 22 disposed spaced away from each other at an angle of approximately 160° or 200°. The two guide grooves 22 are roughly semi-circular in cross-section.

The plug 30 is provided with two connecting ports 32 which together with a cable 34 serve to contact the contact pins 12. Furthermore, the plug 30 is provided with an RF coil 36.

At its outer surface area the plug 30 comprises two keys 38, only one of which is evident from FIG. 1. These keys have a cross-section matching that of the guide grooves 22 and serve for correct positioning of the plug 30 relative to the base 14 and to the contact pins 12 of the igniter 10.

For contacting the contact pins 12 the plug 30 together with the sealing ring 40 is plugged into the receptacle section 20 of the base 14, this being possible in one position only. Subsequently a collar 24 configured in the receptacle section 20 is crimped so that it lies against a boss 42 configured on the plug 30. The plug is then firmly connected to the base and the igniter.

What is claimed is:

1. An igniter unit for an inflator, said igniter unit comprising a base in which electric contact pins are arranged, and a plug for plugging into said base to contact said contact pins, said plug being provided with at least one key and said base being provided with at least one guide groove for said key, wherein said base is provided with a collar and said plug is provided with a boss, said collar being crimped so as to engage said boss.

2. The igniter unit as set forth in claim 1, wherein two keys and two guide grooves are provided arranged angularly spaced away from each other by an angle other than 180°.

3. The igniter unit as set forth in claim 1, wherein a sealing ring is disposed between said base and said plug.

4. The igniter unit as set forth in claim 1, wherein arranged in said base is an igniter from which said electric contact pins protrude.

* * * * *